US007430833B2

(12) United States Patent
Pulte

(10) Patent No.: US 7,430,833 B2
(45) Date of Patent: Oct. 7, 2008

(54) UNIVERSAL RAKE-RIDGE CAP

(75) Inventor: William J. Pulte, Bloomfield Hills, MI (US)

(73) Assignee: PN II, Inc., Bloomfield Hills, MI (US)

( * ) Notice: Subject to any disclaimer, the term of this patent is extended or adjusted under 35 U.S.C. 154(b) by 570 days.

(21) Appl. No.: 10/811,569

(22) Filed: Mar. 29, 2004

(65) Prior Publication Data

US 2004/0250485 A1 Dec. 16, 2004

Related U.S. Application Data

(60) Provisional application No. 60/458,298, filed on Mar. 28, 2003.

(51) Int. Cl.
*E04D 13/15* (2006.01)

(52) U.S. Cl. ..... 52/57; 52/90.1; 52/94; 52/105; D25/136

(58) Field of Classification Search ..... 52/90.1, 52/57, 198, 91.1, 91.3, 94, 262, 745.06, 287.1, 52/105, 656.9, 288.1, 656.7, 656.2; D25/52, D25/55, 60, 135, 136, 199
See application file for complete search history.

(56) References Cited

U.S. PATENT DOCUMENTS

| | | | | | |
|---|---|---|---|---|---|
| 250,637 | A | * | 12/1881 | Baker | 52/287.1 |
| D20,407 | S | * | 12/1890 | Babcock | D25/140 |
| 2,204,927 | A | | 6/1940 | Cramer | |
| 3,183,596 | A | | 5/1965 | Shaw | |
| 3,464,167 | A | * | 9/1969 | Mason | 52/22 |
| D276,273 | S | * | 11/1984 | Shaw | D25/140 |
| 4,606,374 | A | | 8/1986 | Kolenc et al. | |
| 4,651,434 | A | | 3/1987 | Haynes | |
| 4,684,106 | A | | 8/1987 | Kolenc et al. | |
| 4,909,006 | A | * | 3/1990 | Hickman et al. | 52/288.1 |
| 5,295,662 | A | | 3/1994 | Yamaji et al. | |
| D355,859 | S | | 2/1995 | Schroeder | |
| 5,457,923 | A | * | 10/1995 | Logan et al. | 52/288.12 |
| 5,485,984 | A | | 1/1996 | Itoi et al. | |
| 5,768,795 | A | | 6/1998 | Jimenez | |
| 5,933,976 | A | | 8/1999 | Pressuitti et al. | |
| 6,092,550 | A | | 7/2000 | Gotch et al. | |
| 6,098,302 | A | | 8/2000 | Gilliam | |
| 6,216,407 | B1 | * | 4/2001 | LeBlanc | 52/287.1 |
| 6,269,595 | B1 | * | 8/2001 | Blubaugh et al. | 52/105 |
| 6,341,758 | B1 | | 1/2002 | Shih et al. | |
| 2002/0166299 | A1 | * | 11/2002 | Day | 52/211 |

* cited by examiner

*Primary Examiner*—Brian Glessner
*Assistant Examiner*—Adriana Figueroa
(74) *Attorney, Agent, or Firm*—Dobrusin & Thennisch PC

(57) ABSTRACT

A universal rake-ridge cap for a gable roof design that includes a first surface, a second surface, and at least one stepped arcuate surface intersecting the first surface and the second surface. The universal rake-ridge cap is employed to conceal any gap at the junction of two rake boards in a gable roof design. The universal rake ridge cap can be cut so that the arcuate surface will tangentially intersect the stepped surfaces of rake members to provide an aesthetically pleasing transition from rake board to universal rake-ridge cap to rake board. The universal rake-ridge cap can quickly be fitted to any gable roof pitch simply by culling the universal rake-ridge cap to the angle or pitch required by the gable roof. No special tools are needed and the final result is both aesthetically pleasing as well as a significant time saver.

2 Claims, 14 Drawing Sheets

UNIVERSAL RAKE-RIDGE CAP

RELATED APPLICATIONS

This application claims the benefit of U.S. Provisional Application No. 60/458,298, filed Mar. 28, 2003, the entire contents of which are herein incorporated by reference.

FIELD OF THE INVENTION

The present invention relates generally to gable roof designs of residential and commercial construction and, more particularly, to a fascia used to conceal the junction at which two rake boards meet at the peak of a gable roof.

BACKGROUND OF THE INVENTION

One popular style of roof design used both in residential and commercial construction is known as a gable roof. Gable roof designs generally resemble the shape of a triangle. Gable roofs designs can be constructed in a variety of angles or pitches, from shallow pitches to very steep pitches. Homes built with gable style roofs are typically trimmed using what is known in the art as a rake board to cover the intersection between a building's facade and its roof. Rake boards typically follow the pitch of a roof and form a junction when two rake boards meet at the peak of the gable roof.

When thin profile materials such as aluminum sheeting, vinyl or the like are used in the fabrications of rake boards, various means are used to minimize, or eliminate the gap formed at the junction of the rake boards. For example, caulking is commonly used to eliminate gaps. Likewise, a piece of sheet aluminum, vinyl, or the like can be custom fit on site to cover the gap. In any event, no matter which of the above-referenced techniques are used to conceal the gap, at best, they are time consuming and expensive. Additionally, because of the expansion and contraction cycles experienced by many thin profile materials, even if gaps are perfectly closed, they open with the passage of time and render an unattractive appearance. The present invention conceals this gap by use of a universal rake-ridge cap which can accommodate any roof pitch and is easily and quickly fitted in place at the job site by using ordinary tools.

SUMMARY OF THE INVENTION

The present invention provides a solution to a field problem by providing a universal rake-ridge cap for the rake ridge of a gable roof that can be quickly cut to fit any roof pitch. The universal rake-ridge cap may consist of any number of stepped arcuate surfaces. The universal rake-ridge cap is cut to so that the stepped arcuate surfaces tangentially intersect the stepped profiles of both rake boards. Further trimming allows the universal rake-ridge cap to conform to the pitch of any gable roof.

The universal rake-ridge cap provides a time savings to the installer of rake boards. The junction of the rake boards at the peak of a gable roof no longer requires precision fitting to create an aesthetically pleasing joint. A gap can be left at the junction of the rake boards to be covered by the universal rake-ridge cap that can be quickly cut to blend the stepped contours of the rake boards with the stepped arcuate surfaces of the universal rake-ridge cap.

The universal rake-ridge cap is also aesthetically pleasing because the stepped arcuate surfaces of the universal cap provide a single sightline at the peak of a gable roof. When the universal rake-ridge cap is cut and installed so that the stepped arcuate surfaces tangentially intersect the stepped contours of the rake boards, a smooth transition is created from rake board to universal cap to rake board.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION

Figure 1:
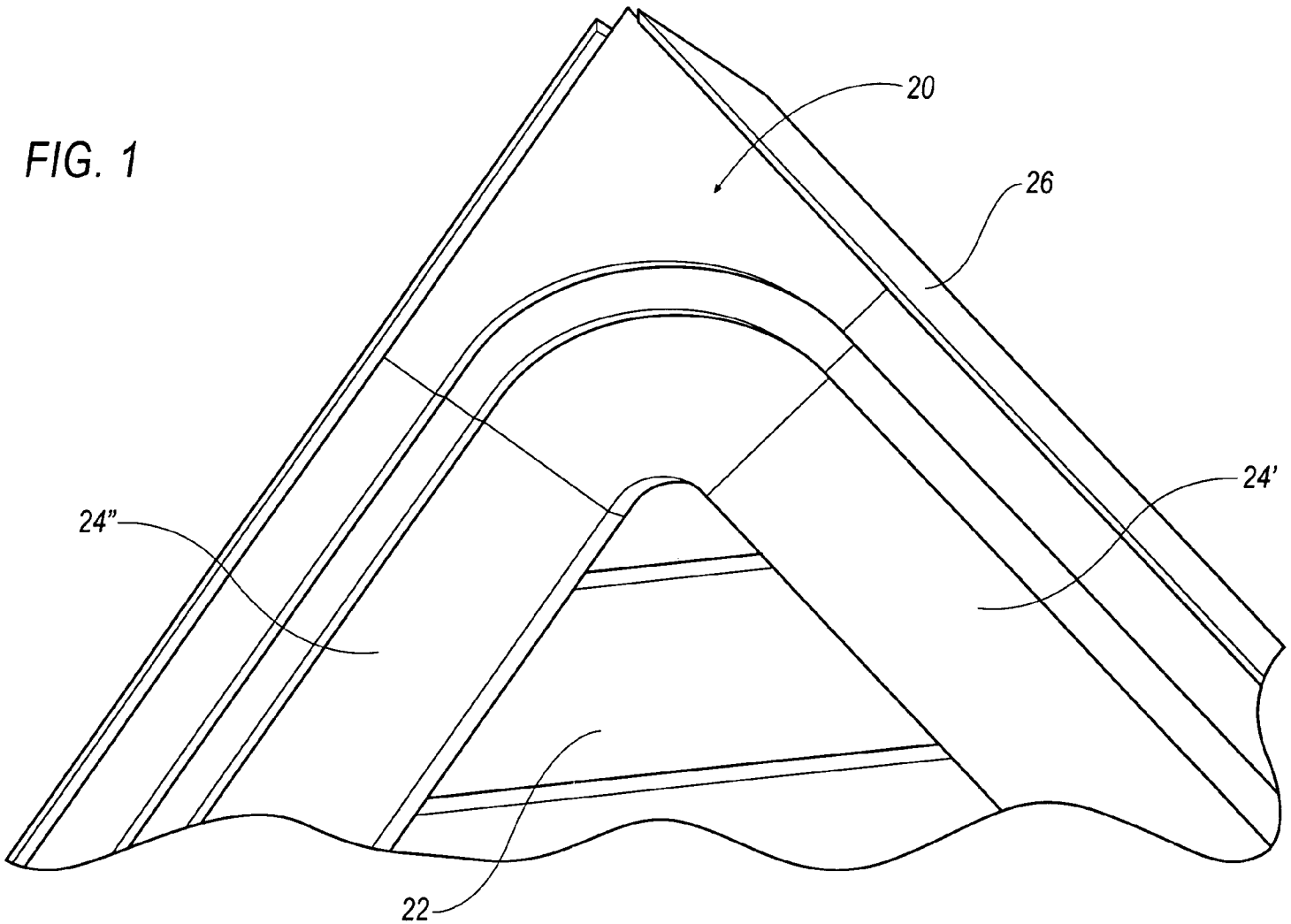
FIG. 1 is a perspective view of the universal rake-ridge cap shown installed on a gable roof design.

Referring now to the drawings, the several embodiments of the present invention are shown in detail. Although the drawings represent some embodiments of the present invention, the drawings are not necessarily to scale and certain features may be exaggerated to better illustrate and explain the present invention. Further, the embodiments set forth herein are not intended to be exhaustive or otherwise limit or restrict the invention to the precise forms and configurations shown in the drawings and disclosed in the following detailed description.

Figure 2B:
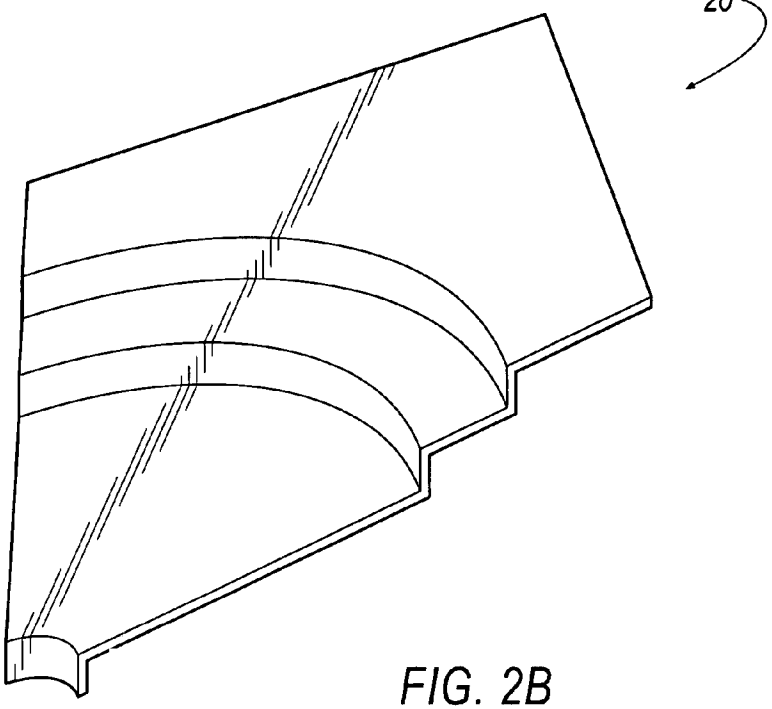
FIGS. 2A and 2B are perspective views of two embodiments of the universal rake-ridge cap.
Figure 2A:
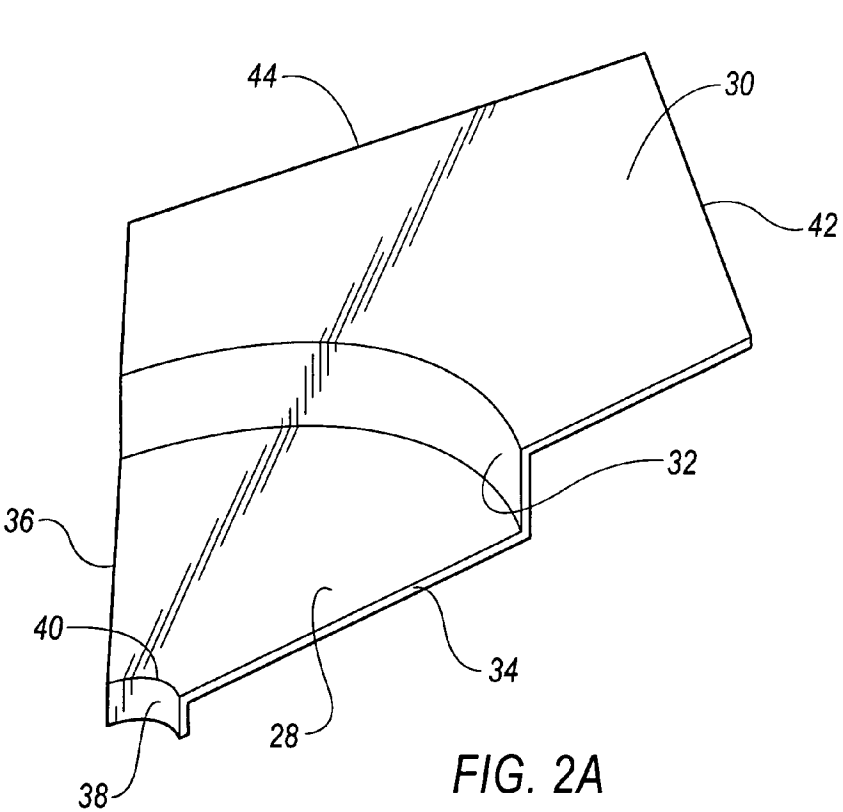

The present invention is directed to an innovative universal rake-ridge cap 20 shown in FIG. 1 as part of a structure's trim package including a facade 22, rake members 24', 24". For clarity, final roof sheating and roofing materials have been omitted from FIG. 1. FIG. 2A illustrates universal rake-ridge cap 20 according to an embodiment of the invention. In the illustrated embodiment, universal rake-ridge cap 20 includes a first surface 28, a second surface 30, and at least one stepped arcuate surface 32 that intersects first surface 28 and second surface 30. Universal rake-ridge cap 20 further includes a first edge 34, a second edge 36, an arcuate surface 38 that intersects vertically with a third edge 40 on first surface 28, a fourth edge 42, and a fifth edge 44. FIG. 2B illustrates universal rake-ridge cap 20 according to a second embodiment of the invention. Universal rake-ridge cap 20 shown in FIG. 2B includes multiple stepped arcuate surfaces 32.

Universal rake-ridge cap 20 can be manufactured from any number of common construction materials. In a preferred embodiment, it is contemplated that aluminum, vinyl, fiberglass, resin, or the like would be the preferred fabrication materials for universal rake-ridge cap 20.

Figure 3A:
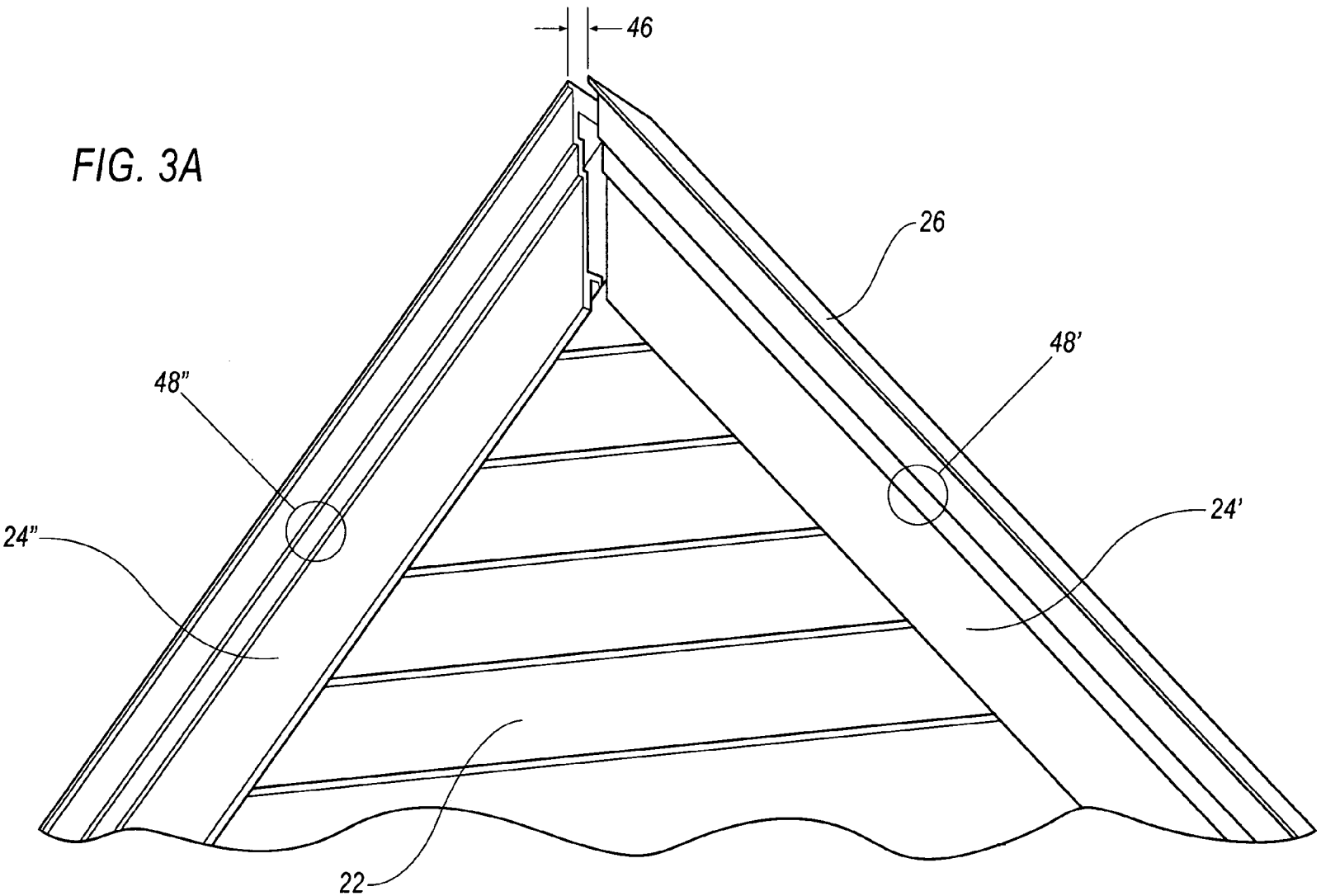
FIGS. 3A and 3B are perspective views showing a roof gable before and after installation of the universal rake-ridge cap.
Figure 3B:
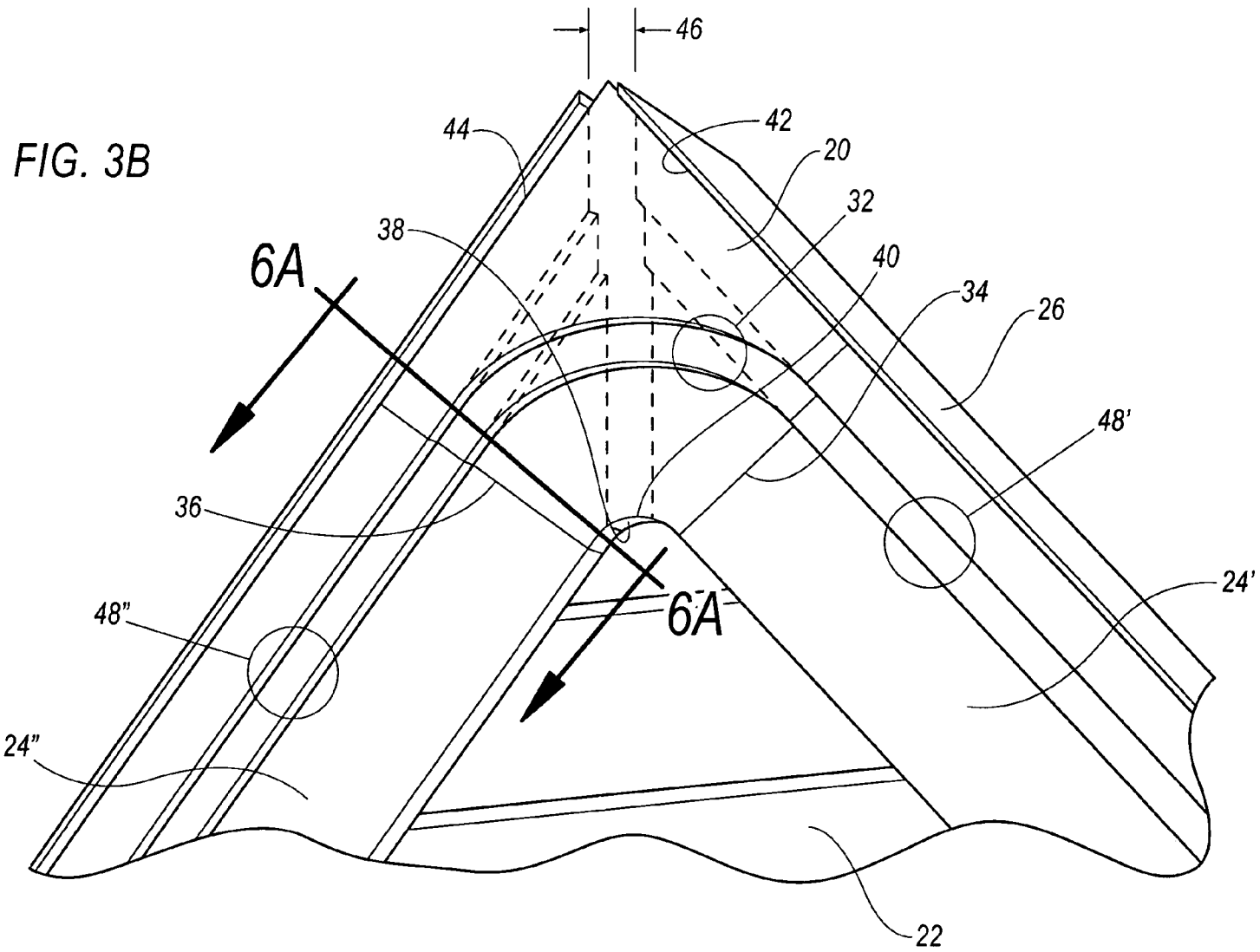
Figure 3C:
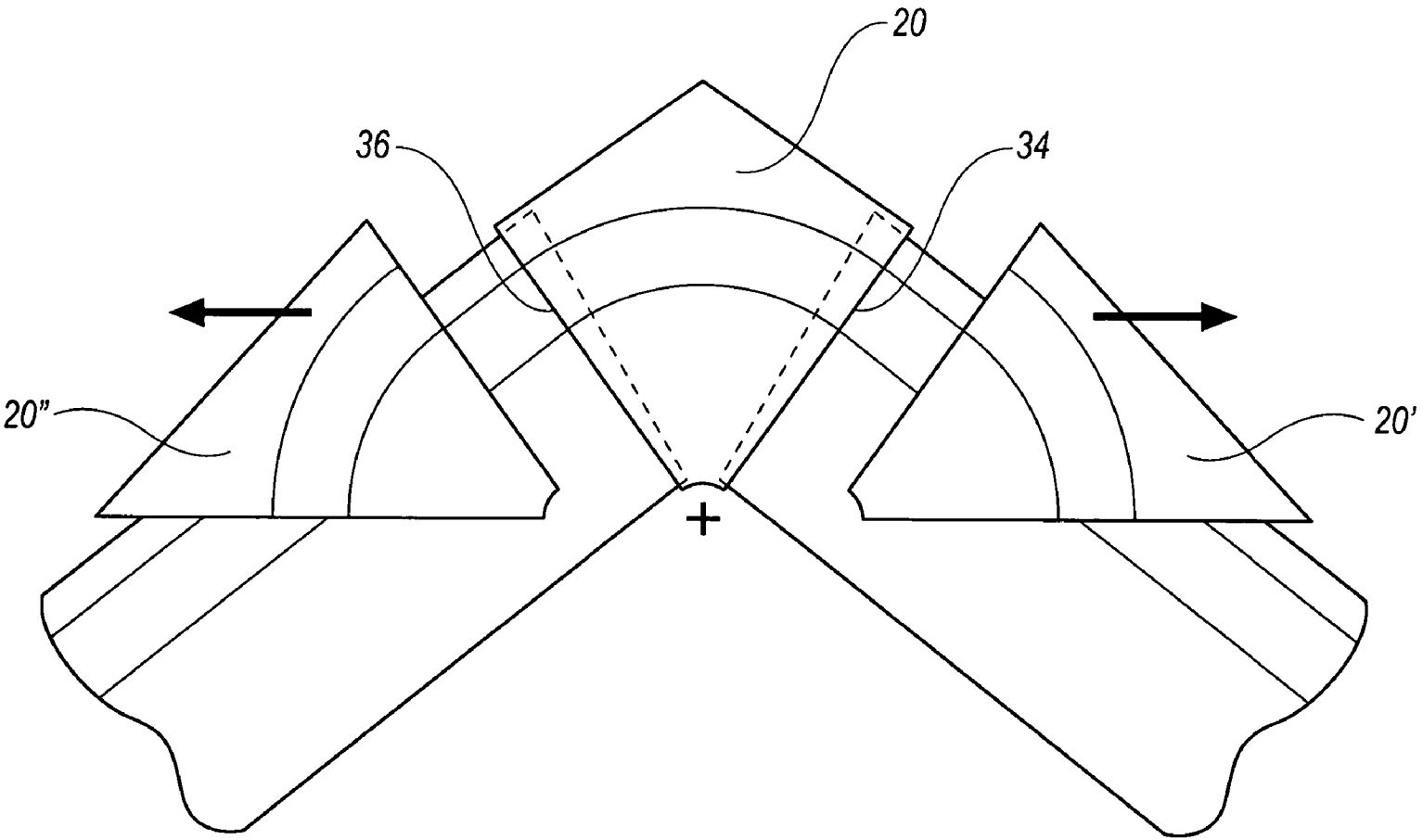
FIG. 3C is a plan view of the universal rake-ridge cap showing how the right side portion and left side portion of the universal rake-ridge cap are cut so that it can be fitted onto a gable roof.

Now referring to FIGS. 3A, 3B, and 3C, once rake members 24', 24" are installed as shown over a structure's facade 22, universal rake-ridge cap 20 is placed over gap 46 and a right side portion 20' is cut from universal rake-ridge cap 20 to reveal first edge 34 of universal rake-ridge cap 20 and a left side portion 20" is cut from universal rake-ridge cap 20 to reveal second edge 36 of universal rake-ridge cap 20. Universal rake-ridge cap 20 is cut such that stepped surfaces 48', 48" of rake members 24', 24" tangentially intersect stepped arcuate surface 32 of universal rake-ridge cap 20. When right side portion 20' and left side portion 20" are cut, a further arcuate surface 36, which intersects vertically with third edge 38, is formed to tangentially intersect the undersides of rake members 24', 24".

Fourth edge 42 and fifth edge 44 of universal rake-ridge cap 20 are cut so that fourth edge 42 and fifth edge 44 are parallel to the top of rake members 24', 24". Fourth edge 42 and fifth edge 44 are cut to generally abut the adjacent extending edge 26 of rake members 24', 24". Fourth edge 42 and fifth edge 44 of universal rake-ridge cap 20 can be cut in a manner that will accommodate a wide variance of gable roof pitches.

Figure 3D:
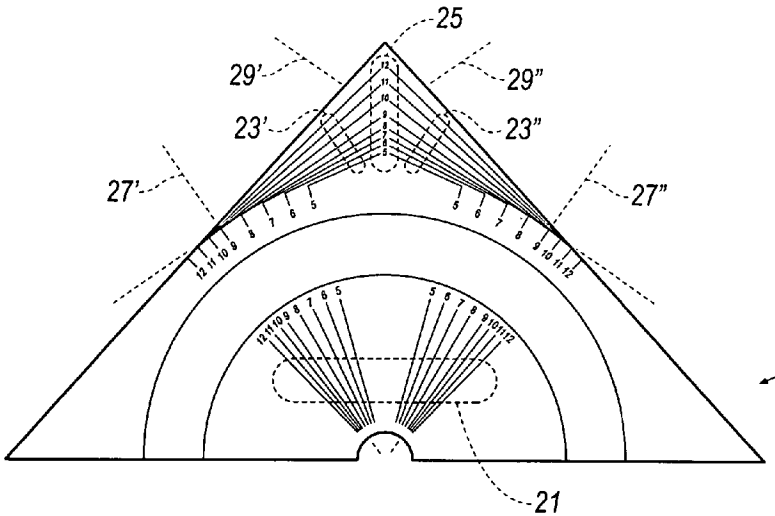
FIG. 3D is a rear view of the universal rake-ridge cap of FIG. 3A-3C prior to trimming various portions.
Figure 3E:
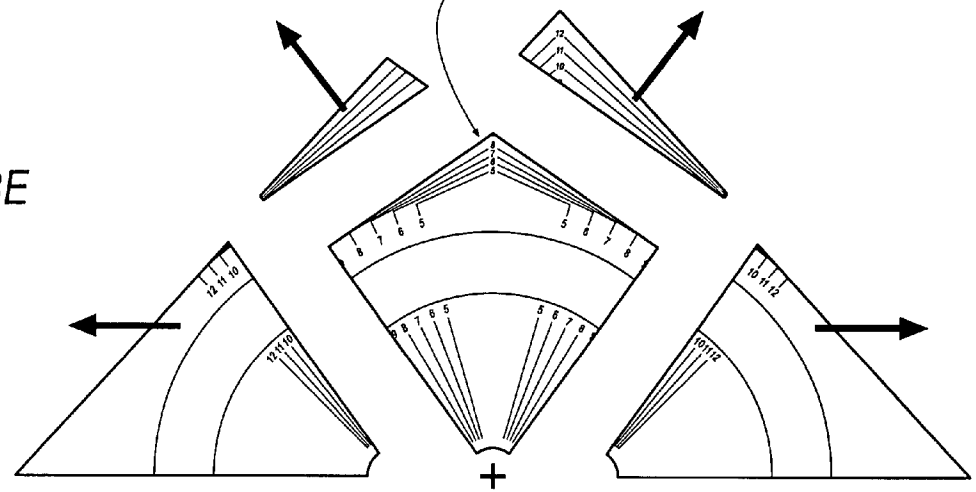
FIG. 3E is a depiction of the universal rake-ridge cap of FIG. 3D wherein various portions are trimmed therefrom to make the universal rake-ridge cap properly fit to match a particular roof slope.

Now referring to FIGS. 3D and 3E, the back side of universal rake-ridge cap 20 is demarked by a series of radially extending lines 21 and a series of tangentially extending lines 23. These lines of demarcation are numbered so that an installer can easily and quickly trim the universal rake-ridge cap 20 to fit the roof pitch under consideration. For example, if radial line "9" (radial line 9 referenced as 27', 27") corresponds to the correct roof pitch under consideration, the installer simply cuts universal rake-ridge cap 20 along the right 27" and left 27' radial line-marks indicated by "9". This assures that when the corresponding rake members 24', 22' are overlayed by universal rake-ridge cap 20, the step surfaces 48', 48" of rake members 24', 24" will tangentially intersect the stepped arcuate surfaces 32 of universal rake-ridge cap 20. Likewise, the installer will locate the appropriate upper, tangential guidelines 23', 23" and trims along the appropriately numbered lines 29', 29" to fit the top portion of universal rake-ridge cap 20. This trimming operation is shown in an exploded view in FIG. 3E wherein the remaining core 20' is the portion of universal rake-ridge cap 20 that is installed on the home. The remaining portions that are trimmed therefrom are discarded.

Figure 4A:
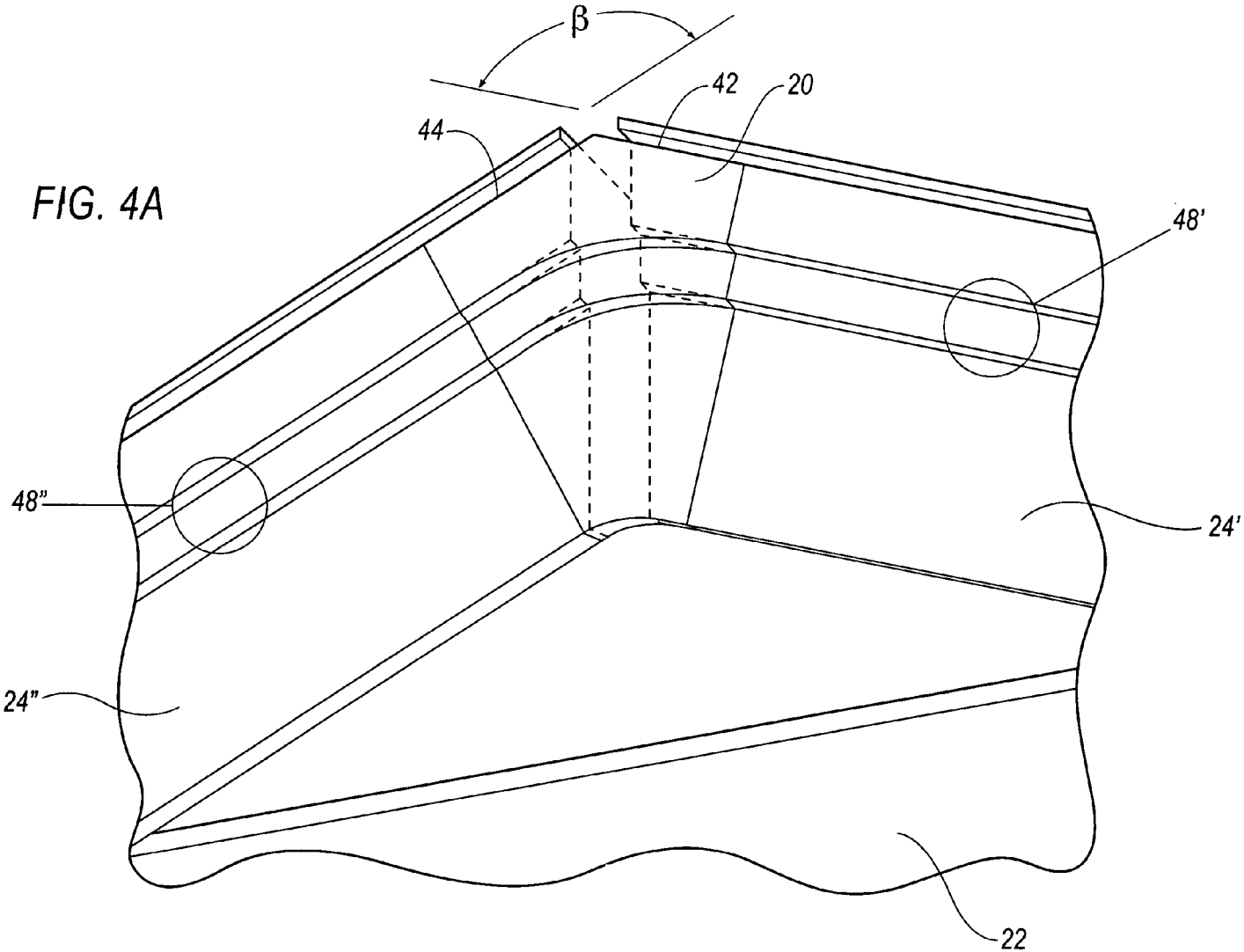
FIGS. 4A and 4B are perspective views showing how that universal rake-ridge cap can accommodate different gable roof pitches.
Figure 4B:
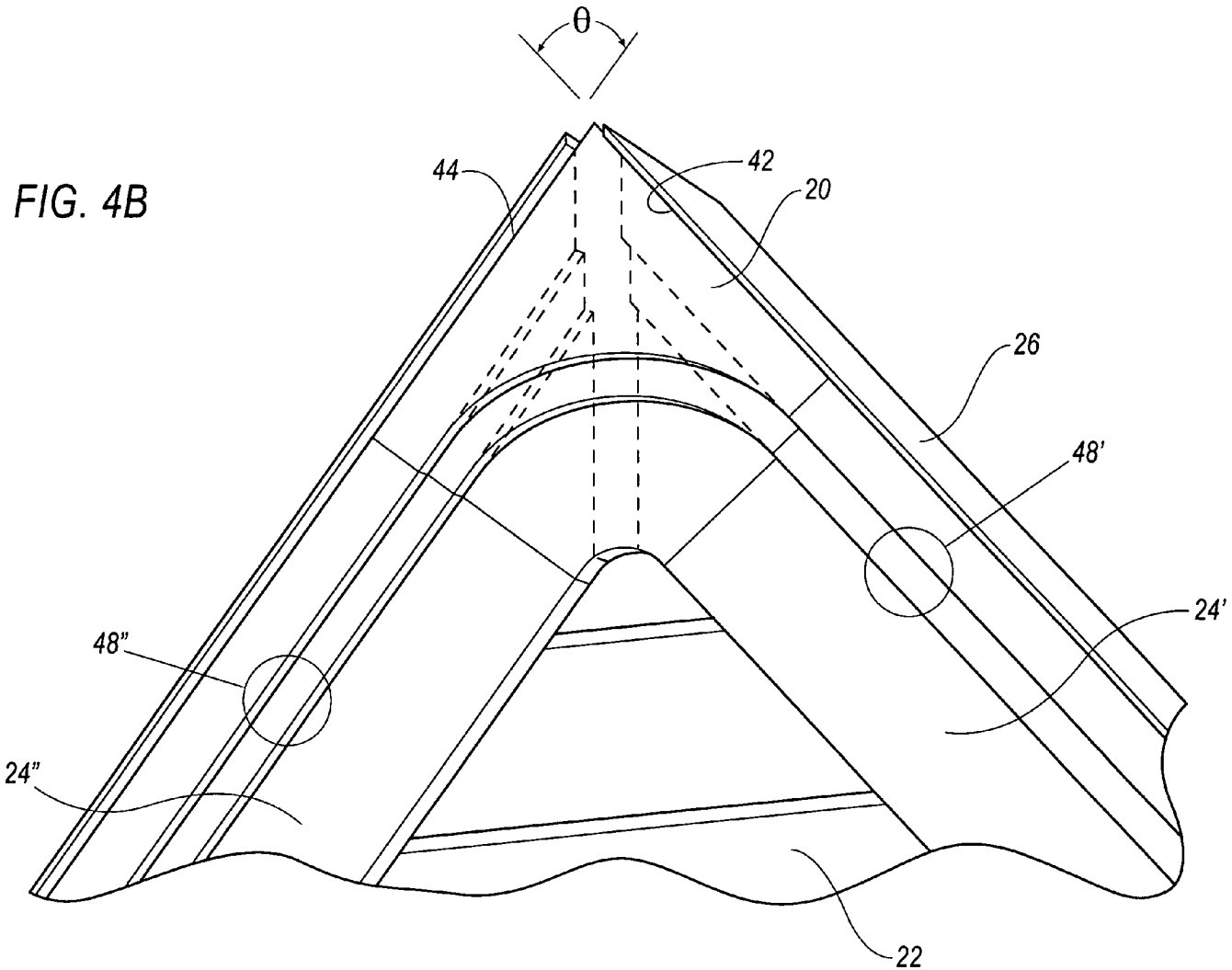
Figure 4C:
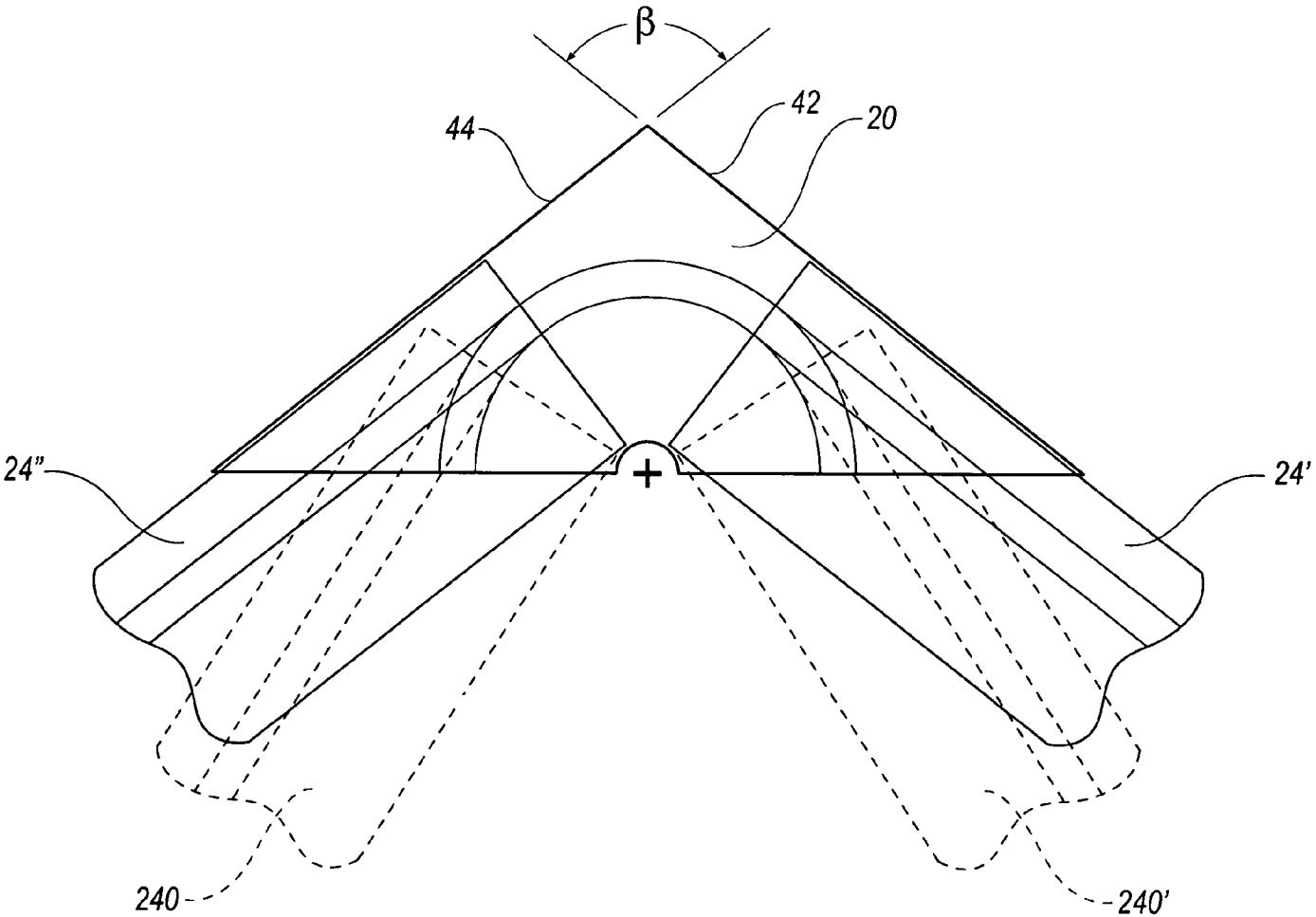
FIG. 4C is an elevational view showing how the universal rake-ridge cap accommodates different gable roof pitches.

FIGS. 4A and 4B illustrate two different pitches of gable roof as shown by angle βand angle Θ. FIG. 4B illustrates a steeper gable roof design than the gable roof design of FIG. 4A. FIG. 4C illustrates the two gable roof pitches superimposed on top of one another. The solid lines of rake members 24', 24" illustrate the shallow roof pitch of FIG. 4A. The ghost lines of rake members 240', 240" illustrate the steeper roof pitch of FIG. 4B. Although different gable roof pitches are illustrated, the same universal rake-ridge cap 20 can be trimmed to fit both gable roof designs by adjusting the amount of material removed from fourth edge 42 and fifth edge 44 of universal rake-ridge cap 20 (as illustrated in FIGS. 3D and 3E).

Figure 5:
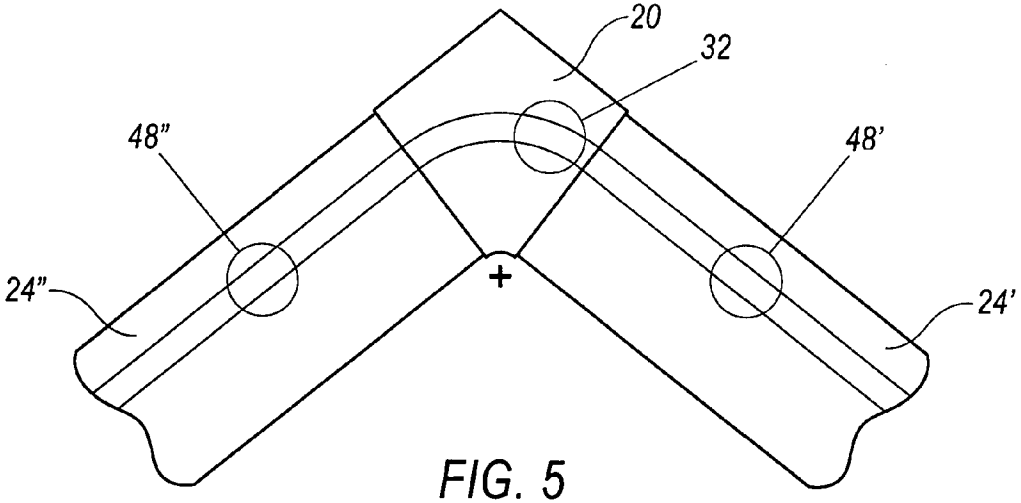
FIG. 5 is an elevational view of the universal rake-ridge cap positioned in place with two rake members.

When universal rake ridge cap 20 is fitted in this manner, stepped arcuate surface 32 of universal rake-ridge cap 20 cooperatively blend with stepped surfaces 48', 48" of rake members 24', 24" thereby forming an attractive finish joint as shown in FIGS. 1 and 5.

Figure 6A:
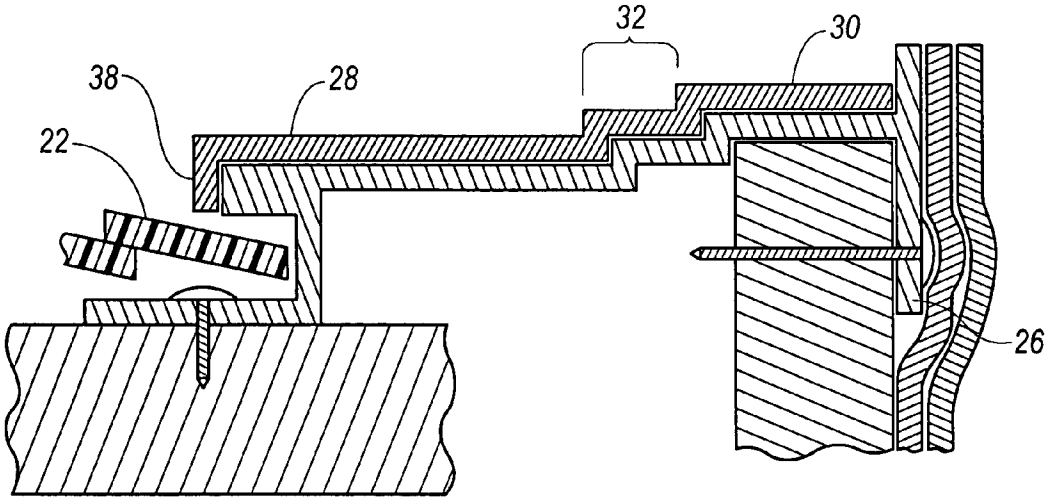
FIG. 6A is a cross sectional view taken through lines 6A-6A of FIG. 3B displaying a stepped arcuate surface.
Figure 6B:
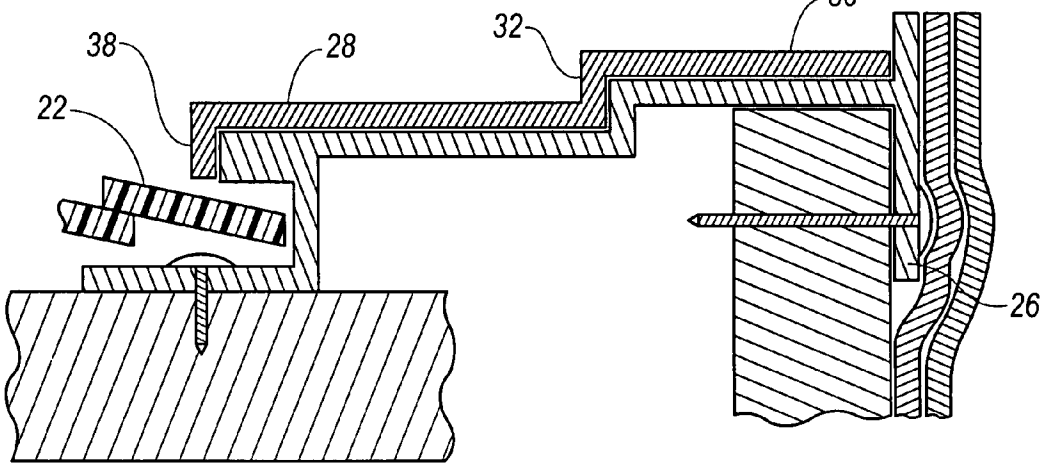
FIGS. 6B through 6H are cross sections of the universal rake-ridge cap displaying other contemplated stepped arcuate surface designs.
Figure 6E:
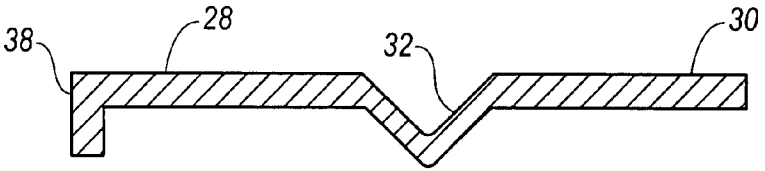
Figure 6F:
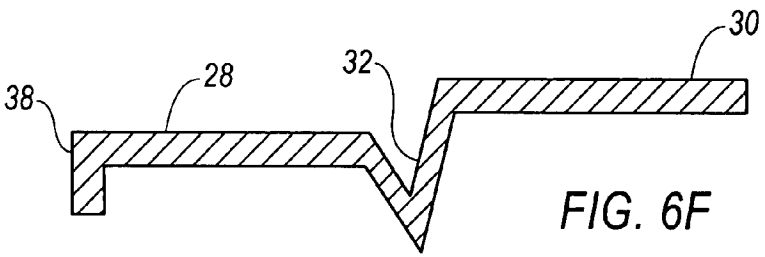
Figure 6G:
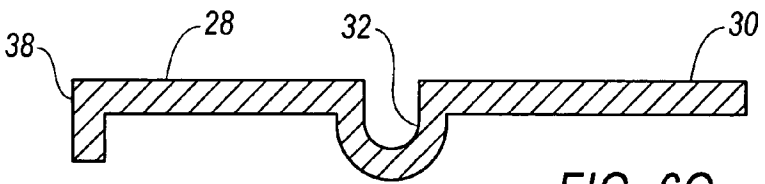
Figure 6H:
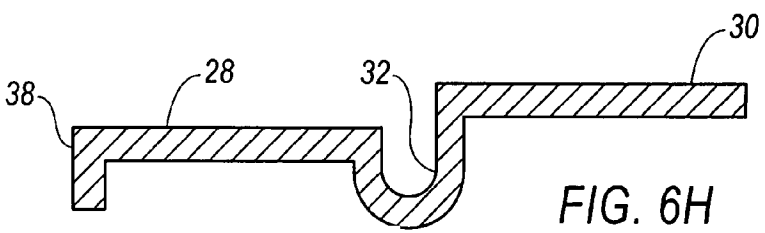
Figure 6C:
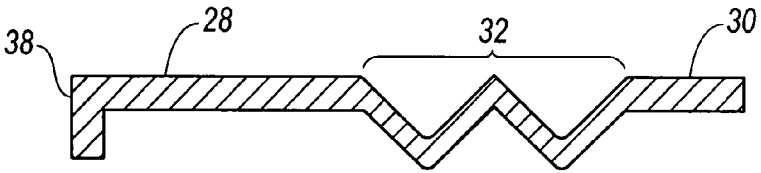
Figure 6D:
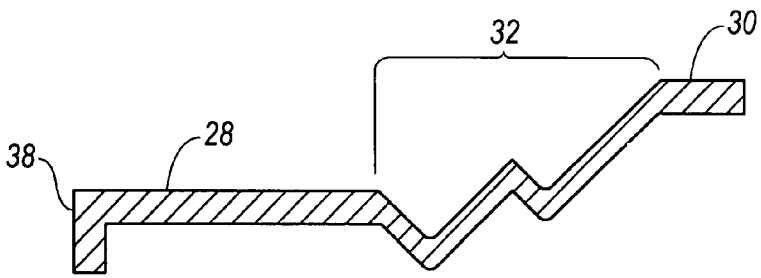

FIG. 6A illustrates a cross section of universal rake-ridge cap 20 taken through lines 6A-6A of FIG. 3B in FIGS. 6B, 6C, 6D illustrate other contemplated cross sections of stepped arcuate surface 32 of universal rake-ridge cap 20 that may be in the shape of a "U", "V", or "W" or variations thereof. It is important to note that the process set forth above for installing universal rake-ridge caps is quick, requires no special tools, and does not required a skilled craftsman. Yet, the finished look is professional and aesthetically pleasing.

Figure 7:
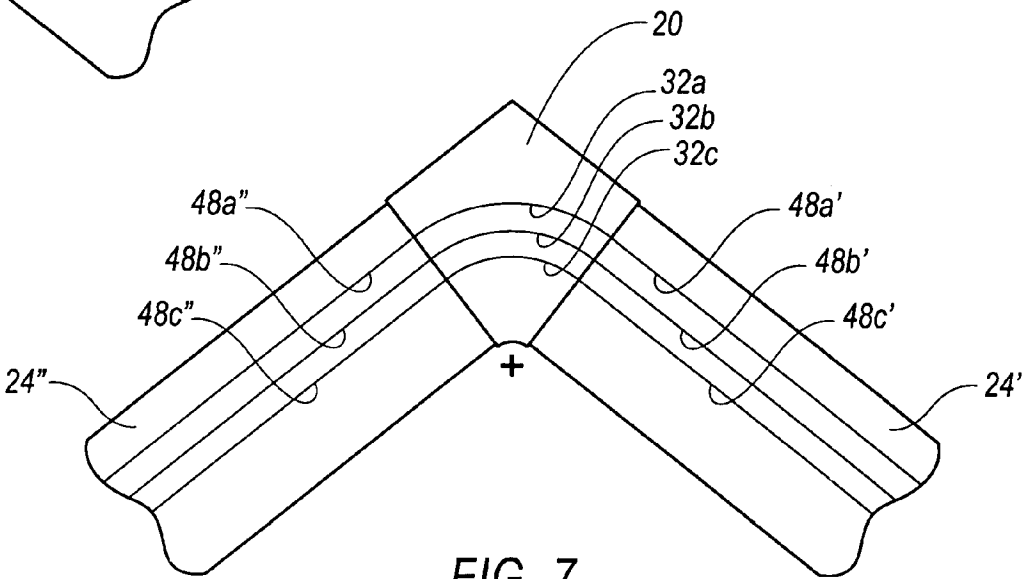
FIG. 7 is an elevational view of the universal rake-ridge cap showing multiple stepped arcuate surfaces tangentially intersecting with multiple stepped surfaces of the two rake members.

FIG. 7 illustrates universal rake-ridge cap 20 with a plurality of stepped arcuate surfaces 32*a*, 32*b*, and 32*c* that correspond with an equal number of stepped surfaces 48*a'*, 48*a"*, 48*b'*, 48*b"*, and 48*c'*, 48*c"* of rake members 24', 24". Further, stepped arcuate surfaces 32*a*, 32*b*, and 32*c* and stepped surfaces 48*a'*, 48*a"*, 48*b'*, 48*b"*, and 48*c'*, 48*c"* increase the detail of universal rake-ridge cap 20 and rake members 24', 24" thereby increasing the aesthetically pleasing look of a gable roof peak. Universal rake-ridge cap 20 may contain any number of stepped arcuate surfaces and rake members 24', 24" may contain any number of stepped surfaces to satisfy the aesthetic requirements of the structure. FIG. 7 illustrates an embodiment of the invention with three stepped arcuate surfaces.

Figure 8A:
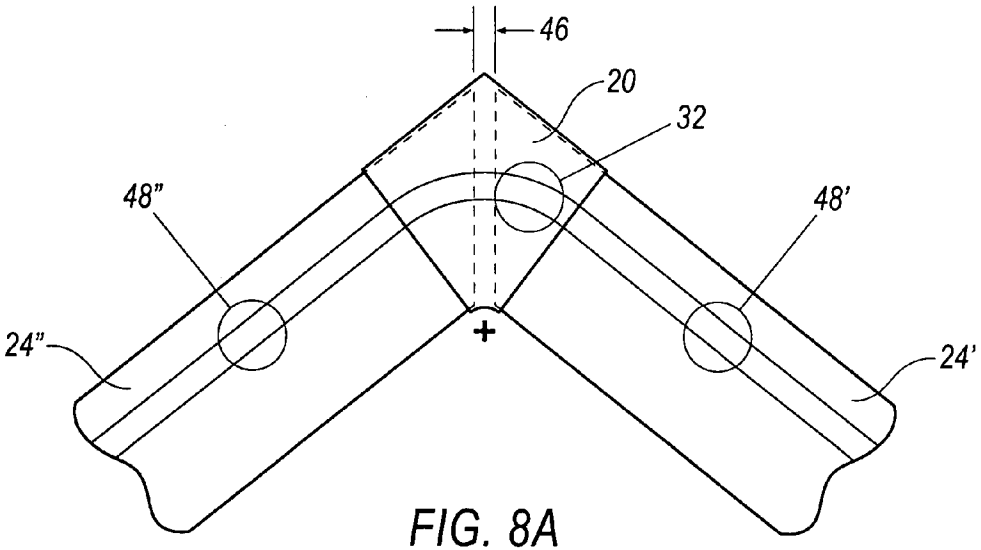
FIGS. 8A and 8B are elevational views of the universal rake-ridge cap showing how the universal rake-ridge cap accommodates different gap widths at the junction of two rake members at the peak of a gable roof.
Figure 8B:
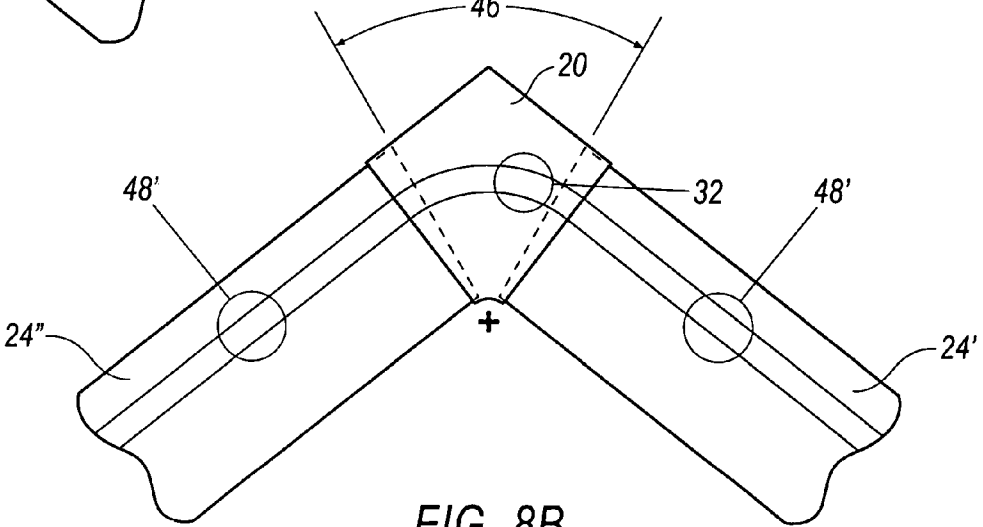

Now referring to FIGS. 8A and 8B, one of the advantages of universal rake-ridge cap 20 of the present invention is how it renders uncritical the fitting of rake members 20', 20" at the junction of the peak of the gable roof. For example, when FIG. 8A is compared to FIG. 8B, FIG. 8A shows rake members 24', 24" being trimmed such that gap 46 is relatively small. In contrast, FIG. 8B shows rake members 24', 24" being trimmed such that gap 46 is relatively large. However, in either application, universal rake-ridge cap 20 is perfectly suited for concealing gap 46. In both instances a high quality final trim product results regardless of the size of gap 46.

Figure 9:
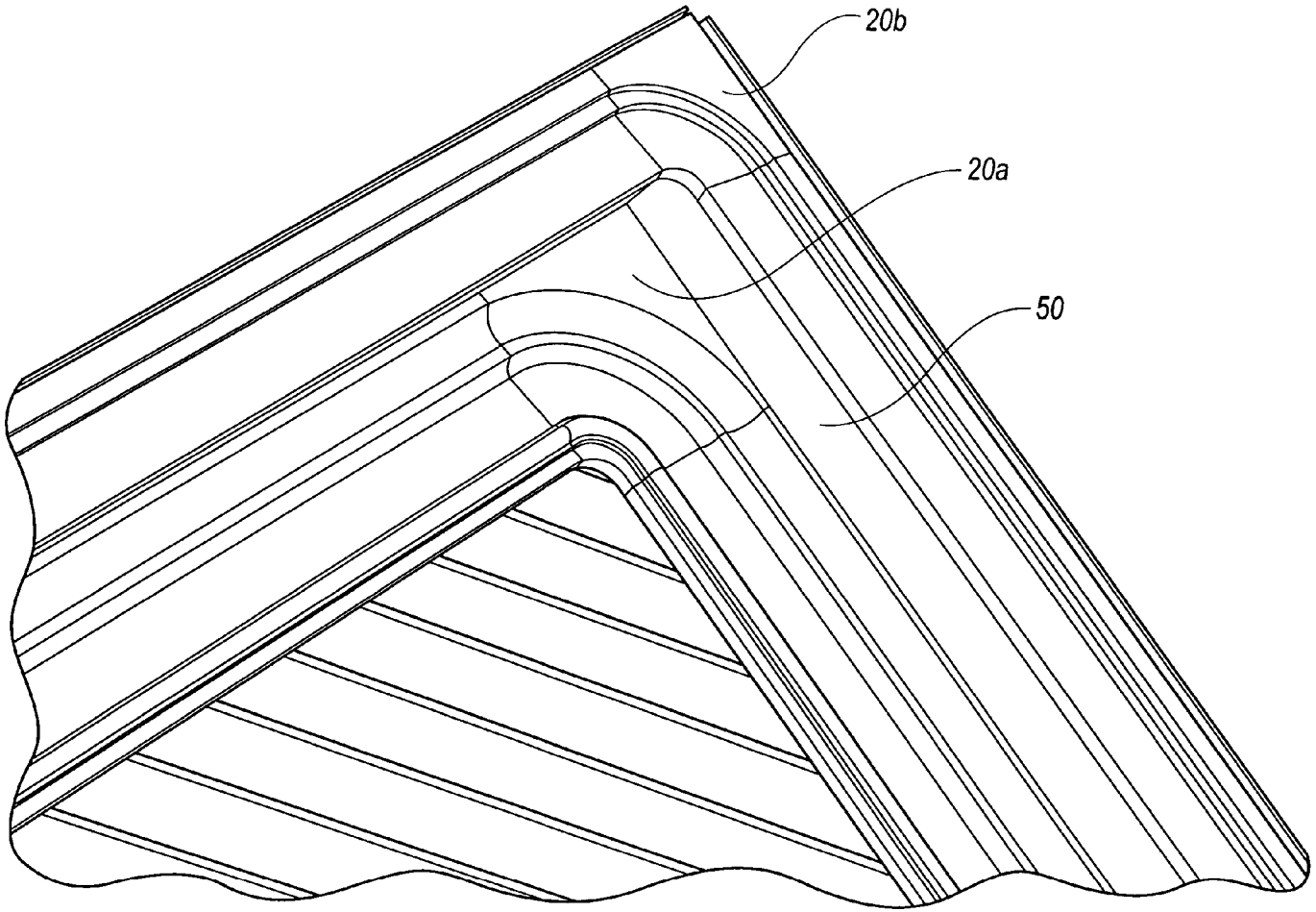
FIG. 9 is a perspective view of multiple universal rake-ridge caps and their use with a gable roof design that includes a soffit.

Now referring to FIG. 9, not only is universal rake-ridge cap 20 applicable for gabled roof designs having no soffit (such as has been shown in FIGS. 3A, 3B, 4A, and 4B), it is also equally applicable in gabled roof designs that have a soffit 50. In roof designs such as shown in FIG. 9, two universal rake-ridge caps 20*a*, 20*b* would be required. Universal rake-ridge cap 20*a* would be used in a manner that has already been described whereas universal rake-ridge cap 20*b* would be used on the outermost portion of soffit 50 as shown in FIG. 9. Universal rake-ridge cap 20*a* as it has herein been described is perfectly capable of functioning in the position shown as 20*b* (the outermost portion of soffit 50), and accordingly no further description is needed in association with universal rake-ridge cap 20*b*.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A universal rake-ridge cap assembly, the universal rake-ridge cap assembly comprising:

i. two angularly disposed opposing rake boards that are part of a gable roof assembly, each including a stepped surface structure with a thin walled cross-sectional profile, which define a gap therebetween at a junction; a cap member including ii. a flat first surface having a first edge and a second edge;

iii. a flat second surface having a first edge, a second edge and, iv. at least one stepped arcuate surface intersecting said first surface and said second surface at said second edge of said first surface and said first edge of said second surface;

v. an arcuate surface that intersects said first edge of said first surface and is orthogonal thereto thereby defining an arcuate junction;

vi. a backside of the first surface and second surface demarked by a series of radially extending lines and a series of tangentially extending lines, said radially extending lines and said tangential extending lines numerically marked to correspond to a roof pitch of a home to which said assembly shall be attached;

wherein the stepped arcuate surfaces correspond with an equal number of stepped surfaces of the opposing rake boards securely attached and defining a joint that is part of the gable roof assembly, wherein said cap has been cut along the tangentially extending lines and the radially extending lines that correspond to the pitch of the rake members, said cap covering the entire junction of the rake members, wherein said cap conceals any gap between the rake members, and wherein the assembly adjoins a soffit and is formed of materials suitable in appearance and durability for the exterior fascia of a home.

2. The assembly of claim 1, wherein the first surface and second surface overlap the opposing rake boards and the second edge of the second surface includes a fourth edge and a fifth edge that are parallel to the top of the rake boards and intersect at a point at the top of a gable roof so that imperfections in spacing are concealed.

* * * * *